US011267675B2

(12) United States Patent
Derwinski et al.

(10) Patent No.: US 11,267,675 B2
(45) Date of Patent: Mar. 8, 2022

(54) COOLING SYSTEM FOR ELEVATOR WITH ELECTRONIC VISUAL DISPLAYS

(71) Applicant: OTIS ELEVATOR COMPANY, Farmington, CT (US)

(72) Inventors: Patricia Derwinski, Farmington, CT (US); Cuauhtemoc Castro, Florence, SC (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 299 days.

(21) Appl. No.: 16/592,813

(22) Filed: Oct. 4, 2019

(65) Prior Publication Data

US 2021/0101780 A1 Apr. 8, 2021

(51) Int. Cl.

| | |
|---|---|
| ***G10H 1/28*** | (2006.01) |
| ***G10H 5/00*** | (2006.01) |
| ***B66B 5/00*** | (2006.01) |
| ***B66B 1/28*** | (2006.01) |
| ***B66B 3/00*** | (2006.01) |
| *B66B 1/34* | (2006.01) |

(52) U.S. Cl.

CPC ..... *B66B 5/0006* (2013.01); *B66B 1/28* (2013.01); *B66B 3/008* (2013.01); *B66B 1/3415* (2013.01)

(58) Field of Classification Search

CPC .. B66B 1/00; B66B 1/28; B66B 3/008; B66B 1/302; B66B 1/3415; B66B 11/001; B66B 3/002; B66B 1/34; B66B 1/3446; B66B 5/00

See application file for complete search history.

(56) References Cited

U.S. PATENT DOCUMENTS

| | | | | |
|---|---|---|---|---|
| 2,350,389 | A | 6/1944 | Coulton et al. | |
| 2003/0043091 | A1* | 3/2003 | Takeuchi | G02B 26/02 345/84 |
| 2006/0104023 | A1* | 5/2006 | Lee | G06F 1/20 361/679.48 |
| 2008/0161976 | A1* | 7/2008 | Stanimirovic | F24F 11/89 700/276 |
| 2008/0230207 | A1* | 9/2008 | Nakamura | F24F 5/0089 165/56 |
| 2011/0116016 | A1* | 5/2011 | Mikubo | G02F 1/133308 349/70 |

(Continued)

FOREIGN PATENT DOCUMENTS

| | | | |
|---|---|---|---|
| EP | 3064462 | A1 | 9/2016 |
| KR | 20120055910 | A | 6/2012 |

(Continued)

OTHER PUBLICATIONS

European Search Report for European Patent Application No. EP 20199339 dated Feb. 8, 2021.

*Primary Examiner* — Marlon T Fletcher

(74) *Attorney, Agent, or Firm* — Carlson, Gaskey & Olds, P.C.

(57) ABSTRACT

This disclosure relates to a cooling system for an elevator with electronic visual displays, and a corresponding method. An example system includes an elevator car having an inner wall, and an electronic visual display mounted to the inner wall so as to define a gap between the inner wall and the electronic visual display. Further, fluid is configured to flow through the gap to cool the electronic visual display.

16 Claims, 4 Drawing Sheets

(56) References Cited

U.S. PATENT DOCUMENTS

| | | | | |
|---|---|---|---|---|
| 2011/0204720 | A1* | 8/2011 | Ruiz | B60L 53/14 307/66 |
| 2012/0304550 | A1* | 12/2012 | Teixeira Pinto Dias | B66B 11/001 52/30 |
| 2014/0260399 | A1* | 9/2014 | Vandermeulen | F24F 3/1411 62/271 |
| 2015/0062314 | A1* | 3/2015 | Itoh | H04N 13/239 348/55 |
| 2017/0083059 | A1* | 3/2017 | Simpson | G06F 1/206 |
| 2018/0011392 | A1* | 1/2018 | Utsunomiya | G03B 21/16 |
| 2018/0105390 | A1* | 4/2018 | Salmikuukka | B66B 3/008 |
| 2018/0105397 | A1* | 4/2018 | Odye | B66B 3/002 |
| 2019/0056127 | A1* | 2/2019 | Piech | F24F 11/79 |
| 2019/0204500 | A1* | 7/2019 | Zhou | G02B 6/0085 |
| 2020/0245512 | A1* | 7/2020 | Kang | G09F 9/35 |
| 2021/0101780 | A1* | 4/2021 | Derwinski | B66B 1/28 |

FOREIGN PATENT DOCUMENTS

| | | | |
|---|---|---|---|
| KR | 20150031664 | A | 3/2015 |
| KR | 20160029413 | A | 3/2016 |
| WO | 2015030435 | A1 | 3/2015 |

* cited by examiner

COOLING SYSTEM FOR ELEVATOR WITH ELECTRONIC VISUAL DISPLAYS

TECHNICAL FIELD

This disclosure relates to a cooling system for an elevator with electronic visual displays, and a corresponding method.

BACKGROUND

Elevator cars are known to include electronic visual displays, which may be configured to display still images or videos to passengers. More recently, in buildings with destination landings, such as upper floor restaurants or observation decks, such electronic visual displays are used to display information about the building and/or the observation deck while the elevator car transports passengers to and from the observation deck.

SUMMARY

A system according to an exemplary aspect of the present disclosure includes, among other things, an elevator car having an inner wall, and an electronic visual display mounted to the inner wall so as to define a gap between the inner wall and the electronic visual display. Further, fluid is configured to flow through the gap to cool the electronic visual display.

In a further non-limiting embodiment of the foregoing system, the system includes a first flow path through which fluid is configured to flow to cool a passenger space, and a second flow path through which fluid is configured to flow to cool the electronic visual display.

In a further non-limiting embodiment of any of the foregoing systems, the system includes a plurality of sets of electronic visual displays and further includes a plurality of second flow paths, and each of the second flow paths is arranged adjacent to a respective one of the sets of electronic visual displays.

In a further non-limiting embodiment of any of the foregoing systems, each set of electronic visual displays includes a first electronic visual display mounted vertically above a second electronic visual display.

In a further non-limiting embodiment of any of the foregoing systems, the passenger space is interior of the sets of electronic visual displays.

In a further non-limiting embodiment of any of the foregoing systems, the passenger space is fluidly coupled to a source of fluid by a first flow path inlet configured to direct fluid into the passenger space beneath the electronic visual display, and the passenger space is fluidly coupled to a location outside the elevator car by a first flow path outlet arranged above the electronic visual display.

In a further non-limiting embodiment of any of the foregoing systems, the gap is fluidly coupled to a source of fluid by a second flow path inlet arranged adjacent a bottom of the electronic visual display, and the gap is fluidly coupled to a location outside the elevator car by a second flow path outlet arranged adjacent a top of the electronic visual display.

In a further non-limiting embodiment of any of the foregoing systems, the second flow path inlet is vertically above the first flow path inlet.

In a further non-limiting embodiment of any of the foregoing systems, the second flow path outlet is vertically below the first flow path outlet.

In a further non-limiting embodiment of any of the foregoing systems, the system includes a second flow path inlet fan arranged adjacent the second flow path inlet and configured to direct fluid to the gap, and a second flow path outlet fan arranged adjacent the second flow path outlet and configured to draw fluid out of the gap.

In a further non-limiting embodiment of any of the foregoing systems, the elevator car includes a double-walled thickness including the inner wall and an outer wall spaced-apart from the inner wall, the second flow path inlet fan is at least partially arranged in a space between the inner wall and the outer wall, and the second flow path outlet fan is at least partially arranged in the space between the inner wall and the outer wall.

In a further non-limiting embodiment of any of the foregoing systems, the system includes a temperature sensor configured to generate a signal indicative of a temperature of one of the electronic visual display and the passenger space, and a controller configured to selectively activate the second flow path inlet fan and the second flow path outlet fan in response to the signal.

In a further non-limiting embodiment of any of the foregoing systems, the system includes a controller configured to selectively activate the second flow path inlet fan and the second flow path outlet fan when the electronic visual display is activated.

In a further non-limiting embodiment of any of the foregoing systems, the elevator car is in a building with an observation deck, and the electronic visual display is a screen configured to present at least one of images and video pertaining to the observation deck.

A method according to an exemplary aspect of the present disclosure includes, among other things, establishing a flow of fluid within a gap between an inner wall of an elevator car and an electronic visual display mounted to the inner wall.

In a further non-limiting embodiment of the foregoing method, the method includes establishing a flow of fluid into a passenger space of the elevator car independent of the flow of fluid within the gap.

In a further non-limiting embodiment of any of the foregoing methods, the step of establishing a flow of fluid within the gap includes directing the fluid into the gap using an inlet fan.

In a further non-limiting embodiment of any of the foregoing methods, the method includes drawing air out of the gap using an outlet fan.

In a further non-limiting embodiment of any of the foregoing methods, the method includes activating the inlet fan and the outlet fan in response to a signal from a temperature sensor.

In a further non-limiting embodiment of any of the foregoing methods, the method includes activating the inlet fan and the outlet fan when the electronic visual display is activated.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

DETAILED DESCRIPTION

This disclosure relates to a cooling system for an elevator with electronic visual displays, and a corresponding method. An example system includes an elevator car having an inner wall, and an electronic visual display mounted to the inner wall so as to define a gap between the inner wall and the electronic visual display. Further, fluid is configured to flow through the gap to cool the electronic visual display. Among other benefits, which will be appreciated from the below description, this disclosure provides effective cooling for electronic visual displays within elevator cars, without being unduly large or expensive, and without drawing high power during operation. The system also simplifies maintenance and is scalable in terms of the number of fans, the size of the elevator car, and/or the number of electronic visual displays within the elevator car. Further, the system is low-noise and produces minimal, if any, condensation.

Figure 1:
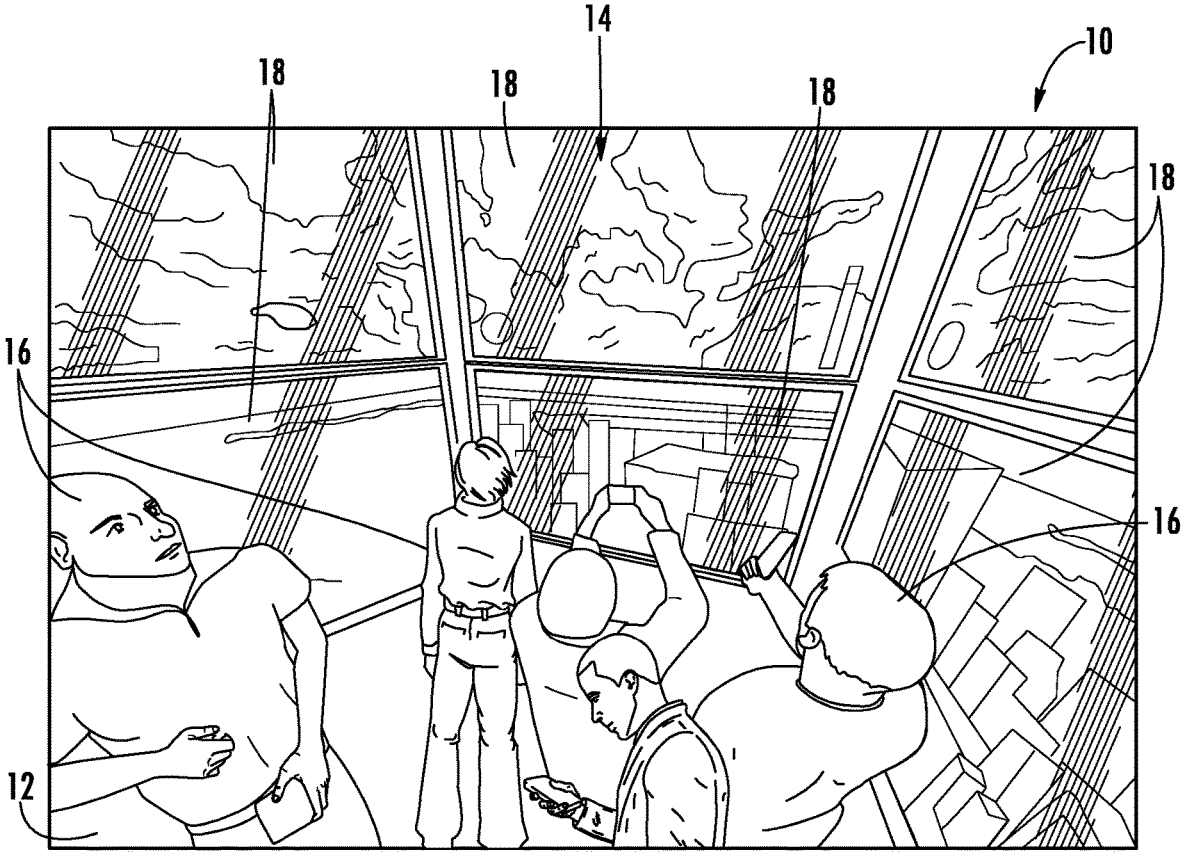
FIG. 1 illustrates a portion of a passenger space of an example elevator car.

FIG. 1 illustrates an example elevator system 10, and in particular illustrates a portion of a passenger space 12 (i.e., passenger cabin) of an elevator car 14. The elevator system 10, in this example, is located in a building with a destination landing, such as an upper floor restaurant or an observation deck. In the example, the elevator car 14 is configured to travel within a hoistway to transport passengers 16 to and from a lobby of the building and the observation deck. While observation decks are mentioned herein, this disclosure is not limited to elevator systems used in buildings with observation decks, and extends to other elevator systems with electronic visual displays including those intended to provide passengers with an immersive media experience.

In the example of FIG. 1, a plurality of passengers 16 are traveling between a lobby and an observation deck. The elevator car 14, in this example, includes a plurality of electronic visual displays 18. The electronic visual displays 18 are arranged relative to one another such that, collectively, the electronic visual displays 18 substantially cover the entirety of the inner walls of the elevator car 14. As such, the electronic visual displays 18 can provide the passengers 16 with an immersive media experience. While a plurality of electronic visual displays are shown in FIG. 1, it should be understood that this disclosure extends to elevator cars with one or more electronic visual displays. Further, while electronic visual displays 18 are shown on three different walls of the elevator car 14 in FIG. 1, this disclosure extends to elevator systems with at least one electronic visual display on at least one wall of an elevator car. The disclosure separately applies to elevator systems with one or more electronic visual displays on a ceiling of the elevator car.

In one example, the electronic visual displays 18 display information about the observation deck to the passengers 16 as they are transported to or from the observation deck. For instance, the electronic visual displays 18 can be used to display an informative video to the passengers 16. The video may include information about the observation deck such as the height of the observation deck, current weather, visibility, visible landmarks, history of the building, and other information. This disclosure is not limited to electronic visual display that play videos that pertain to observation decks, however. The electronic visual displays 18 could display other content such as still images, videos, advertisements, etc. The electronic visual displays 18 could present other types of media.

Figure 2:
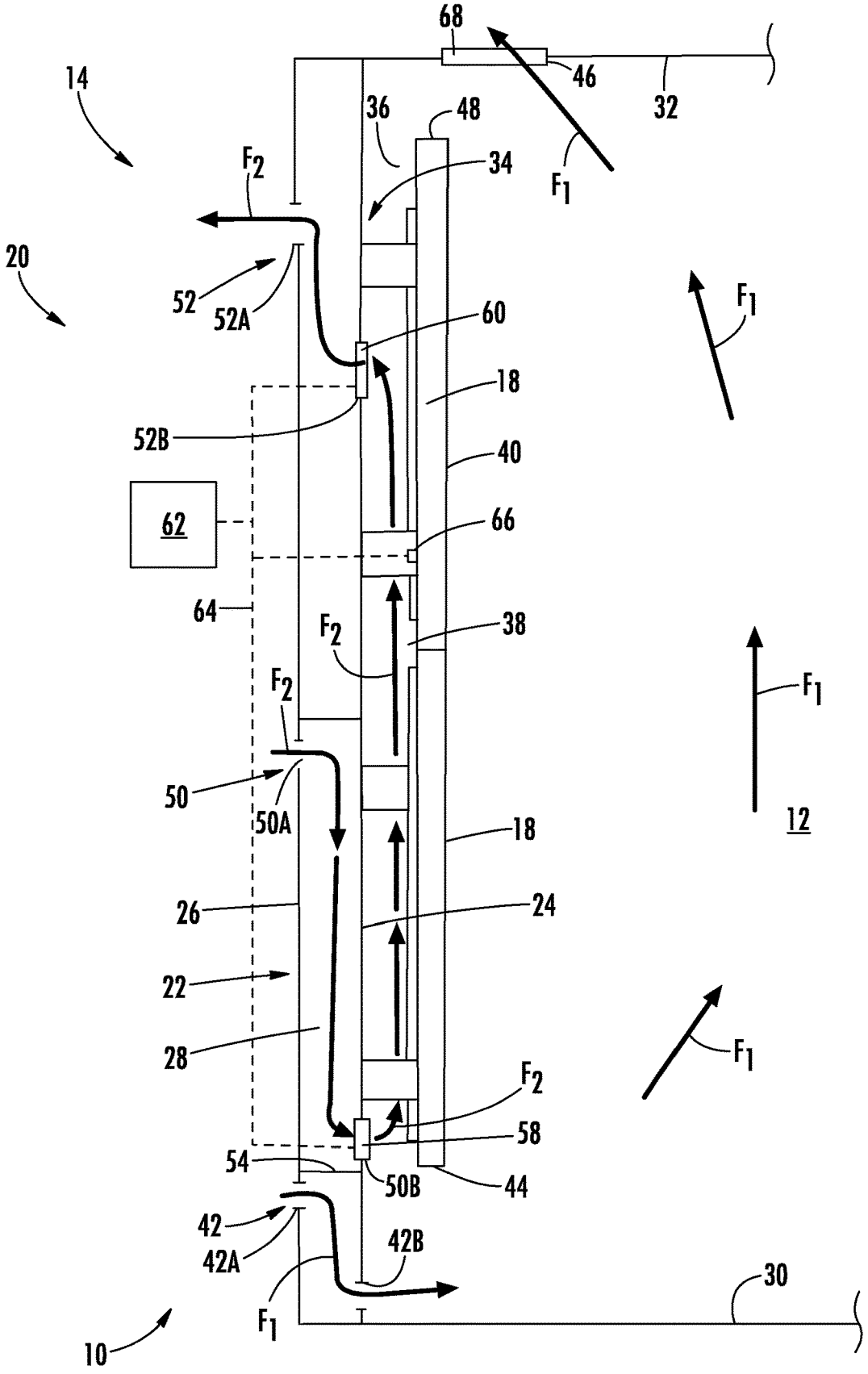
FIG. 2 schematically illustrates a cooling system of the elevator car.

FIG. 2 is a schematic, cross-sectional view of the elevator system 10, and in particular illustrates a cooling system 20 of the elevator car 14. In this disclosure, the cooling system 20 is configured to direct air in a manner that cools the electronic visual displays 18.

The elevator car 14 includes side walls 22 with a shell having a double-walled thickness. One of the side walls 22 is shown in FIG. 2. While a double-walled thickness shell including two spaced-apart panels is shown in FIG. 2, this disclosure extends to side walls having a single-walled thickness shell.

In particular, the side walls 22 each have a double-walled thickness shell provided by an inner wall 24 and an outer wall 26 spaced-apart from the inner wall 24 in a horizontal direction by a space 28. The space 28 is a substantially hollow space in this example. The space 28 may also be at least partially filled with noise attenuating material. In the example of a single-walled thickness shell, other noise attenuating features such as baffles may be incorporated into the shell.

The inner and outer walls 24, 26 are panels, in this example, and extend from a floor 30 of the elevator car 14 to a ceiling 32. Together, the inner walls 24, floor 30, and ceiling 32 define the passenger space 12. Alternatively, there may be decorative panels below the ceiling 32 and/or above the floor 30 which partially define the passenger space 12.

The electronic visual displays 18 are mounted to the inner walls 24, in this example, by way of mounting brackets 34. The mounting brackets 34 are directly attached to both the inner walls 24 and the electronic visual displays 18. The electronic visual displays 18 are mounted such that a back surface 36 of the electronic visual displays 18 faces the inner wall 24 and is spaced-apart from the inner wall 24 so as to define a gap 38 between the inner wall 24 and the electronic visual display 18. In FIG. 2, there are two electronic visual displays 18, with one mounted vertically above another to provide a vertical set of electronic visual displays. While two electronic visual displays 18 are shown vertically arranged relative to one another herein, it should be understood that other electronic visual display arrangements are contemplated by this disclosure. For instance, the two electronic visual displays 18 could be replaced with a single, relatively taller electronic visual display. Alternatively, there could be three or more vertically stacked electronic visual displays 18.

Front surfaces 40 of the electronic visual displays 18, which include a screen, face toward the center of the elevator car 14. The mounting brackets 34 may include vertical and horizontal bracket components. This disclosure is not limited to any particular type of mounting bracket.

The electronic visual displays 18 typically generate and emit heat during use. This disclosure provides a cooling system 20 configured to cool the electronic visual displays 18. In a particular embodiment, fluid is configured to flow through the gap 38 to cool the electronic visual displays 18. The fluid is air, in one example, and thus this disclosure may referred to as a forced air cooling system. As will be appreciated from the below, a particular aspect of this disclosure provides two independent fluid flow paths, one of which is configured to direct fluid to cool the passenger space 12 and one of which is configured to direct fluid through the gap 38 to cool the electronic visual displays 18.

Specifically, cooling system 20 includes a first flow path through which fluid $F_1$ is configured to flow to cool the passenger space 12. In particular, the passenger space 12 is fluidly coupled to a source of fluid $F_1$ by a first flow path inlet 42 configured to direct fluid $F_1$ into the passenger space 12 beneath the electronic visual displays 18. The first flow path inlet 42 includes a first port 42A in outer wall 26 and a second port 42B in inner wall 24 and arranged vertically beneath the first port 42A. The first port 42A is fluidly coupled to air within a hoistway, in one example, and fluid $F_1$ is configured to flow between the first and second ports 42A, 42B within the space 28. The second port 42B is arranged vertically below a bottom-most edge 44 of a bottom one of the electronic visual displays 18 such that fluid $F_1$ may flow to the passenger space 12. The fluid $F_1$ cools the passenger space 12 by directing hot air out an outlet 46 in the ceiling 32, in this example. The outlet 46 is above a top-most edge 48 of a top one of the electronic visual displays 18. The outlet 46 does not need to be in the ceiling 32 in all examples, and could be in an upper section of the side wall 22, for example. The outlet 46 could include a fan 68 configured to direct fluid out of the passenger space 12, in some examples.

The cooling system 20 also includes a second flow path through which fluid $F_2$ is configured to flow to cool the electronic visual displays 18. The fluids $F_1$, $F_2$ may both be air and may both be sourced from a hoistway. The fluids $F_1$, $F_2$ may be sourced from locations other than the hoistway, however. The fluids are referred to separately herein because they are directed through different flow paths.

The gap 38 is fluidly coupled to the fluid $F_2$ by a second flow path inlet 50, which includes a port 50A in the outer wall 26 and a port 50B in the inner wall 24 arranged vertically below the port 50A. The second flow path inlet 50 is vertically above the first flow path inlet 42. Fluid $F_2$ is configured to flow in the space 28 between the port 50A and 50B. The port 50B is arranged adjacent, and in this example slightly above, the bottom-most edge 44 of the bottom electronic visual display 18. As such, fluid $F_2$ exiting the port 50B flows vertically upward through the gap 38 and cools the electronic visual displays 18 by directing hot air away from the electronic visual displays 18.

The fluid $F_2$ flows vertically upward toward a second flow path outlet 52, which includes port 52A in the outer wall 26 and port 52B in the inner wall 24. The port 52B is arranged vertically below the port 52A and is arranged adjacent, and in this example slightly below, the upper-most edge 48 of the upper electronic visual display 18. The second flow path outlet 52 is vertically below the first flow path outlet 46.

The side wall 22 includes two partitions, in this example, to prevent mixing of the various flows of fluid. A first partition 54 extends horizontally between the inner wall 24 and the outer wall 26 and is arranged below the port 50B to prevent the fluid $F_2$ from mixing with fluid $F_1$. A second partition 56 extends horizontally between the inner wall 24 and the outer wall 26 and is arranged above the port 50A to prevent the fluid $F_2$ adjacent the second flow path inlet 50, which is relatively cooler, from mixing with fluid $F_2$ adjacent the outlet 52, which is relatively hotter.

The partitions 54, 56 divide the side wall 22 into three vertical sections in this example. The first section provides first flow path inlet 42 and extends from the floor 30 to the first partition 54, which is at about knee height of an average-height passenger. The second section provides the second flow path inlet 50 and extends vertically between the first partition 54 and the second partition 56, which is at about waist height. The third section provides the second flow path outlet 52 and extends from the second partition 56 to the ceiling 32.

In one example, the flow of fluid $F_2$ is established (i.e., introduced) within the second flow path by passively flowing from the second flow path inlet 50 to the second flow path outlet 52 without being forced by a fan. In another example, the cooling system 20 includes at least one fan (e.g., one at the inlet, one at the outlet, or both) configured to actively establish the flow of fluid $F_2$ through the second flow path. While fans are illustrated relative to the second flow path, it should be understood that one or more fans (e.g., fan 68) could also be used relative to the first flow path in order to actively establish the flow of fluid $F_1$. Alternatively, the flow of fluid $F_1$ may be established passively.

In the example of FIG. 2, the cooling system 20 includes a second flow path inlet fan 58 arranged adjacent the second flow path inlet 50 and configured to direct fluid $F_2$ into the gap 38. The cooling system 20 further includes a second flow path outlet fan 60 arranged adjacent the second flow path outlet 52 and configured to draw, and exhaust, fluid $F_2$ out of the gap 38. The fans 58, 60 are shown schematically in FIG. 2. In this example, the second flow path inlet fan 58 is mounted in the port 50B and is at least partially arranged in the space 28 between the inner wall 24 and the outer wall 26. The second flow path outlet fan 60 is mounted in the port 52B and is at least partially arranged in the space 28. Thus, the fans 58, 60 are at least partially recessed into the side wall 22. The fans 58, 60 may be fully recessed in other examples. In those examples, the fans 58, 60 are completely within the space 28. The fans 58, 60 may also be mounted to the outer wall 26 in examples where it is not possible to mount fans to the inner wall 24.

The fans 58, 60 are electronically connected to a controller 62, and the fans 58, 60 are selectively activated in response to instructions from the controller 62. The controller 62 is shown schematically in FIG. 2. The controller 62 includes electronics, software, or both, to perform the necessary control functions. In one non-limiting embodiment, the controller 62 is an elevator drive controller. Although it is shown as a single device, the controller 62 may include multiple controllers in the form of multiple hardware devices, or multiple software controllers within one or more hardware devices. A controller area network (CAN) 64, illustrated schematically, allows the controller 62 to communicate with various components of the elevator system 10 by wired and/or wireless electronic connections.

In one aspect of this disclosure, the controller 62 is electronically connected to a temperature sensor 66. In FIG. 2, a single temperature sensor 66 is shown. The temperature sensor 66 is mounted adjacent one of the electronic visual displays 18 and is configured to generate a signal indicative of a temperature of the electronic visual displays 18. Additional temperature sensors may be mounted to other electronic visual displays 18. The temperature sensor 66 may alternatively be mounted adjacent the passenger space 12 and be configured to generate a signal indicative of a temperature of the passenger space 12. The controller 62 is configured to selectively activate the fans 58, 60 in response to the signal(s) from the temperature sensor(s). In another example, there are no temperature sensors, and instead the controller 62 activates the fans 58, 60 when the electronic visual displays 18 are activated (i.e., turned on). The controller 62 may also independently activate a fan 68 arranged in outlet 46 based on information from one or more of the temperature sensors, for example.

As mentioned above, the elevator system 10 may include a plurality of electronic visual displays 18. The electronic visual displays 18 may be arranged in vertical sets, with each vertical set including a plurality of electronic visual displays arranged vertically one over the other. FIG. 2 illustrates one such vertical set, and thus includes one second flow path. It should be understood that the cooling system 20 may include additional second flow paths. Specifically, the cooling system 20 may include one second flow path, substantially similar to the one shown in FIG. 2, arranged adjacent each vertical set of electronic visual displays. When there are additional second flow paths, the additional fans may be electronically connected in series (i.e., daisy chained) in order to reduce bulky electrical harnesses.

The cooling system 20 may further include various seals and partitions configured to keep the fluid $F_2$ within the gap 38 and prevent mixing of the fluids $F_1$, $F_2$. The seals and partitions may extend between adjacent electronic visual displays 18, between the inner wall 24 and the electronic visual displays, etc. In one example, the seals and partitions may be provided in part by the mounting brackets 34, various gaskets, and/or other structures such as baffles.

Figure 3:
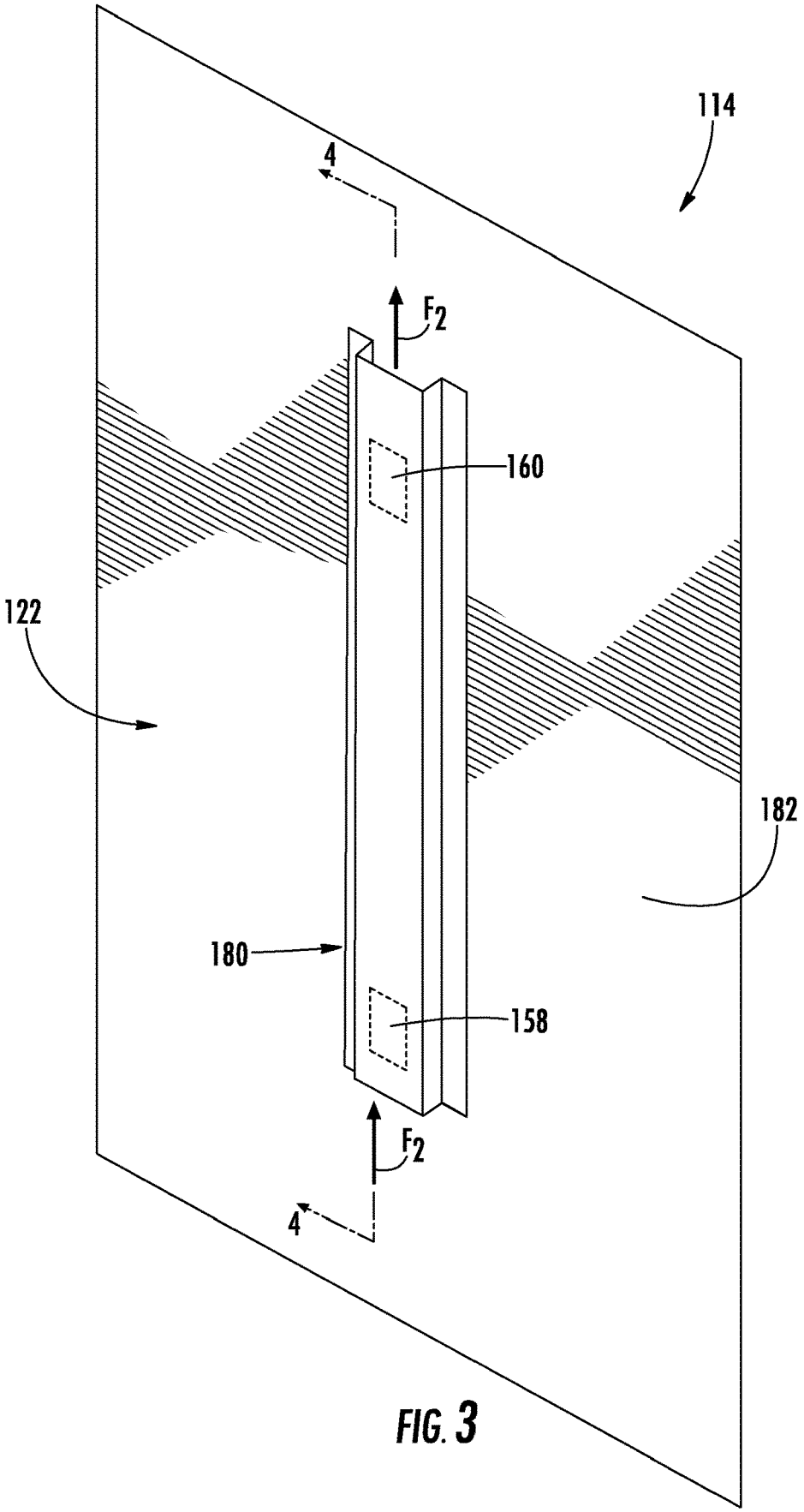
FIG. 3 is a somewhat schematic, perspective view of a side wall of another example elevator car.
Figure 4:
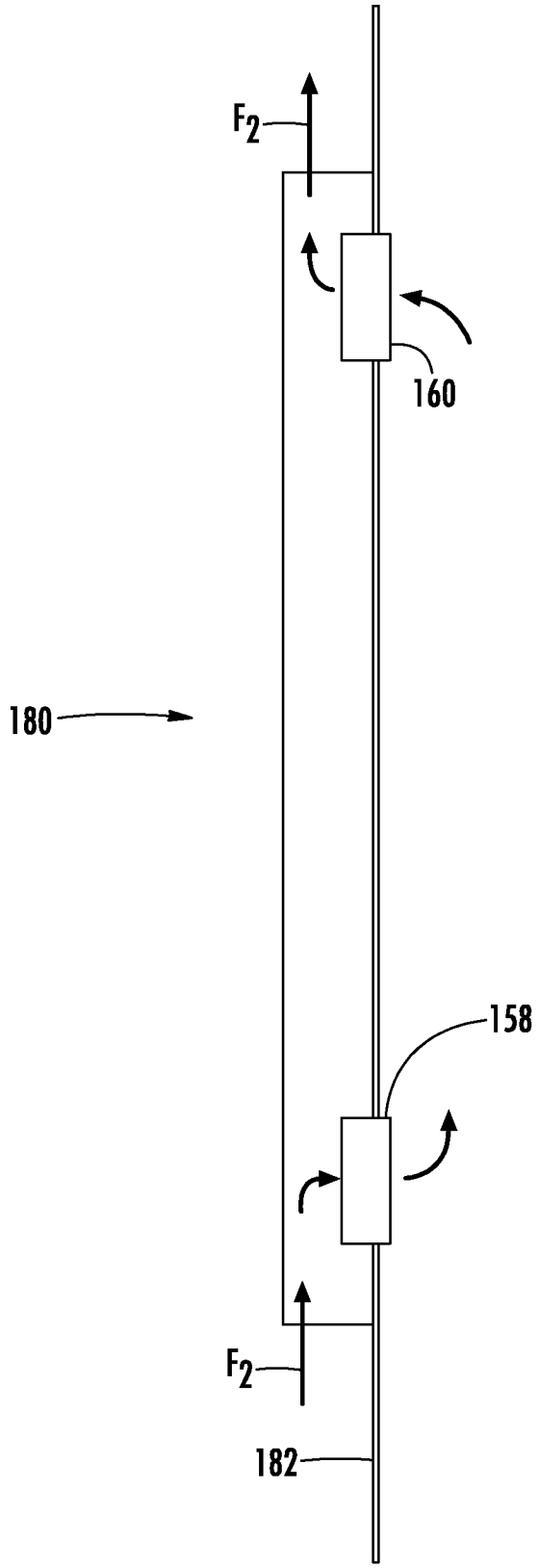
FIG. 4 is a somewhat schematic cross-sectional view taken along line 4-4 in FIG. 3.

FIGS. 3 and 4 illustrate another aspect of the present disclosure. FIGS. 3 and 4 illustrate an elevator car 114 similar to the elevator car 14 with like reference numerals pre-appended with a "1." FIGS. 3 and 4 do not show any electronic visual displays, although they would be arranged similar to the previous embodiment. FIGS. 3 and 4 also only show the second flow path. It should be understood that the first flow path would be arranged similarly to the embodiment of FIG. 2.

The elevator car 114 includes a single-thickness shell side wall 122. In FIG. 3, there is a vertically-arranged baffle 180 on an outer surface 182 of the side wall 122. The outer surface 182 in this example faces the hoistway. The baffle 180 allows fluid such as the fluid $F_2$ to enter and exit at the axial ends of the baffle 180. In this example, the baffle 180 covers fans 158 and 160 and provides protection relative to the fans similar to that which is provided by the outer wall 26 in the previously discussed embodiment. The baffle 180 also attenuates noise and permits fluid to flow in a desired direction. While only one baffle 180 is illustrated in FIGS. 3 and 4, the side wall 122 may incorporate a number of similarly-arranged baffles. Further, the baffle 180 may be used in the embodiment of FIG. 2 to attenuate noise and cover the inlets and/or outlets 42, 50, 52. The baffle 180 may be used when retrofitting existing elevator cars with a system as described herein.

It should be understood that terms such as "generally," "substantially," and "about" are not intended to be boundaryless terms, and should be interpreted consistent with the way one skilled in the art would interpret those terms. Further, directional terms such as "vertical," "horizontal," "above," and "below" are used consistent with their plain and ordinary meanings with reference to the normal operational attitude of an elevator car and should not otherwise be considered limiting.

Although the different examples have the specific components shown in the illustrations, embodiments of this disclosure are not limited to those particular combinations. It is possible to use some of the components or features from one of the examples in combination with features or components from another one of the examples. In addition, the various figures accompanying this disclosure are not necessarily to scale, and some features may be exaggerated or minimized to show certain details of a particular component or arrangement.

One of ordinary skill in this art would understand that the above-described embodiments are exemplary and non-limiting. That is, modifications of this disclosure would come within the scope of the claims. Accordingly, the following claims should be studied to determine their true scope and content.

The invention claimed is:

1. A system, comprising:

an elevator car having an inner wall;

an electronic visual display mounted to the inner wall so as to define a gap between the inner wall and the electronic visual display, wherein fluid is configured to flow through the gap to cool the electronic visual display;

a first flow path through which fluid is configured to flow to cool a passenger space; and a second flow path through which fluid is configured to flow to cool the electronic visual display, wherein the passenger space is fluidly coupled to a source of fluid by a first flow path inlet configured to direct fluid into the passenger space beneath the electronic visual display, wherein the passenger space is fluidly coupled to a location outside the elevator car by a first flow path outlet arranged above the electronic visual display, wherein the gap is fluidly coupled to a source of fluid by a second flow path inlet arranged adjacent a bottom of the electronic visual display, and wherein the gap is fluidly coupled to a location outside the elevator car by a second flow path outlet arranged adjacent a top of the electronic visual display.

2. The system as recited in claim 1, wherein:

the system includes a plurality of sets of electronic visual displays and further includes a plurality of second flow paths, and each of the second flow paths is arranged adjacent to a respective one of the sets of electronic visual displays.

3. The system as recited in claim 2, wherein each set of electronic visual displays includes a first electronic visual display mounted vertically above a second electronic visual display.

4. The system as recited in claim 2, wherein the passenger space is interior of the sets of electronic visual displays.

5. The system as recited in claim 1, wherein the second flow path inlet is vertically above the first flow path inlet.

6. The system as recited in claim 5, wherein the second flow path outlet is vertically below the first flow path outlet.

7. The system as recited in claim 1, further comprising:

a second flow path inlet fan arranged adjacent the second flow path inlet and configured to direct fluid to the gap; and a second flow path outlet fan arranged adjacent the second flow path outlet and configured to draw fluid out of the gap.

8. The system as recited in claim 7, wherein:

the elevator car includes a double-walled thickness including the inner wall and an outer wall spaced-apart from the inner wall, the second flow path inlet fan is at least partially arranged in a space between the inner wall and the outer wall, and the second flow path outlet fan is at least partially arranged in the space between the inner wall and the outer wall.

9. The system as recited in claim 7, further comprising:

a temperature sensor configured to generate a signal indicative of a temperature of one of the electronic visual display and the passenger space; and a controller configured to selectively activate the second flow path inlet fan and the second flow path outlet fan in response to the signal.

10. The system as recited in claim 7, further comprising:

a controller configured to selectively activate the second flow path inlet fan and the second flow path outlet fan when the electronic visual display is activated.

11. The system as recited in claim 1, wherein:

the elevator car is in a building with an observation deck, and the electronic visual display is a screen configured to present at least one of images and video pertaining to the observation deck.

12. A method, comprising:

establishing a flow of fluid along a first flow path through which fluid flows into a passenger space of an elevator car; and establishing a flow of fluid along a second flow path through which fluid flows within a gap between an inner wall of the elevator car and an electronic visual display mounted to the inner wall, wherein the passenger space is fluidly coupled to a source of fluid by a first flow path inlet configured to direct fluid into the passenger space beneath the electronic visual display, wherein the passenger space is fluidly coupled to a location outside the elevator car by a first flow path outlet arranged above the electronic visual display, wherein the gap is fluidly coupled to a source of fluid by a second flow path inlet arranged adjacent a bottom of the electronic visual display, and wherein the gap is fluidly coupled to a location outside the elevator car by a second flow path outlet arranged adjacent a top of the electronic visual display.

13. The method as recited in claim 12, wherein the step of establishing a flow of fluid along the second flow path includes directing the fluid into the gap using an inlet fan.

14. The method as recited in claim 13, further comprising drawing air out of the gap using an outlet fan.

15. The method as recited in claim 14, further comprising activating the inlet fan and the outlet fan in response to a signal from a temperature sensor.

16. The method as recited in claim 14, further comprising activating the inlet fan and the outlet fan when the electronic visual display is activated.

* * * * *